United States Patent [19]

Aardal

[11] 4,065,827

[45] Jan. 3, 1978

[54] MOUNTING OF ROLLERS FOR PATIO DOORS

[75] Inventor: Martin John Aardal, Ewell, England

[73] Assignee: Schlegel (UK) Limited, Leeds, England

[21] Appl. No.: 679,707

[22] Filed: Apr. 23, 1976

[51] Int. Cl.[2] ..... E05D 13/02

[52] U.S. Cl. ..... 16/106; 85/7

[58] Field of Search ..... 16/99, 105, 106, 97, 16/100; 85/7, 79

[56] References Cited

U.S. PATENT DOCUMENTS

| | | | |
|---|---|---|---|
| 545,961 | 9/1895 | Lemmon | 85/79 X |
| 1,462,694 | 7/1923 | Fassett | 16/105 |
| 3,040,391 | 6/1962 | Saunders | 16/99 X |
| 3,492,687 | 2/1970 | Herr | 16/105 |

FOREIGN PATENT DOCUMENTS

| | | | |
|---|---|---|---|
| 253,871 | 8/1964 | Australia | 16/105 |
| 348,626 | 10/1960 | Switzerland | 16/105 |

*Primary Examiner*—Werner H. Schroeder
*Assistant Examiner*—Moshe I. Cohen
*Attorney, Agent, or Firm*—Cumpston & Shaw

[57] ABSTRACT

A roller support for a patio door comprising a roller supported on a support-body which has at least two spaced mounting means on each side and is provided with location means mounted in said mounting means for locating said support body with a close fit within a channel section of a bottom door frame member.

8 Claims, 7 Drawing Figures

MOUNTING OF ROLLERS FOR PATIO DOORS

This invention relates to the mounting of rollers on patio doors and the like. Although the invention will be described in connection with patio doors, it will be appreciated that it could be applied to any type of sliding door or window.

Traditionally, almost all commercially available patio doors have a frame of channel section members normally of extruded aluminium and the weight of the doors is supported by rollers mounted in the bottom frame member so that the door can be slid along a suitable guideway. These rollers are normally largely hidden within the downwardly facing channel portion of the bottom frame member and the present invention is concerned with the mounting of the rollers in such constructions of door. There are many different manufacturers of patio doors in this country using a range of different channel section frame members but at the moment this range of channel section frame members is limited to between five and ten different sizes. At the present time, therefore, it is necessary for roller manufacturers to design many different roller support bodies to fit within the different channel section frame members.

It is the aim of the present invention to design a roller support body which can be used for most of the commercially available patio doors, and which could also be used for specially ordered doors and the like, and even for possible future designs of doors.

According to the present invention, we provide a support body for a roller for a patio door, the support body supporting or being adapted to support a roller and including spaced mounting means on each side face of the body for receiving locating devices for locating the body with a close fit within a channel section of a frame member of the patio door.

Preferably, the body includes the locating devices.

In its simplest form, the body may be formed with two transverse drillings extending generally parallel to the rolling axis of the roller and the locating devices may comprise a pair of locating pins forming a close fit within the drillings and selected from a set of locating pins, the pins of the set being of predetermined lengths to match the internal width of the bottom frame members of known patio doors. If desired, the pins, instead of being cylindrical and extending completely through the drillings so that only two are required for each body, may be of tapered construction so that four would be required for each body, the taper allowing the dimensional tolerance of the drillings to be increased.

Alternatively, the drillings may be tapered to receive cylindrical pins, in which case of course the taper would be such that the diameter of the drillings towards the centre of the body would be less than that at the sides of the body.

In an alternative construction, the drillings may be internally threaded to receive threaded pins. In this case, a set of pins of different predetermined length would be required and simple threaded pins or studs could be located in the threaded drillings which pins, if desired, could be locked into position with suitable locking nuts.

A preferred embodiment of the invention is now described with reference to the accompanying drawings, in which.

Figure 1:
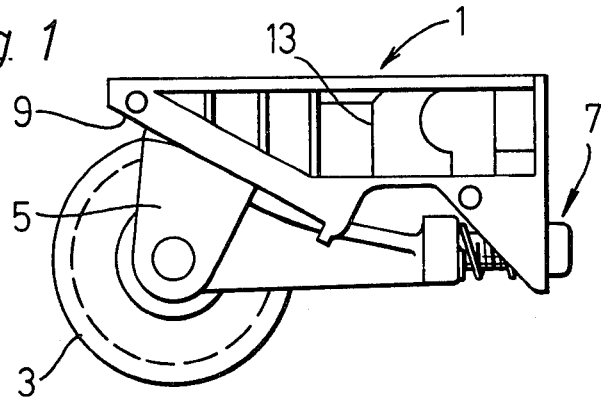
Fig. 1 Prior Art
FIG. 1 is a side elevation of a traditional patio door roller supported on a support body.
Figure 2:
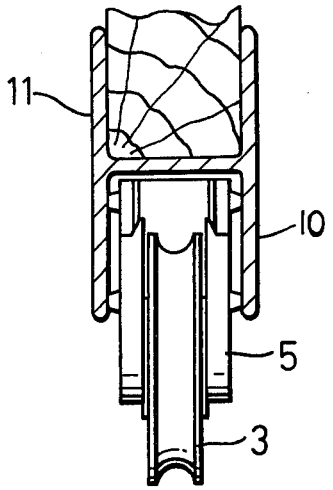
Fig. 2 Prior Art
FIG. 2 is an end elevation of the roller shown located in the lower frame member of a patio door.

Referring to FIGS. 1 and 2, the prior art construction shown therein includes a roller support body 1 supporting a roller 3 mounted on an adjustable roller housing unit 5. The unit 5 is connected to the body 1 by means of a screw 7 and by adjusting the screw, the unit 5 can be caused to move up and down an inclined cam surface 9, thereby altering the distance of the rolling surface of the roller 3 from the top surface of the body 1. In this way, the vertical height of a patio door to which the body is fitted can be altered. As can be seen from FIG. 2, the widths of the body 1 and unit 5 are designed to form a close sliding fit within the inverted side walls 10 of the channel portion of the roller frame member 11 of a patio door (not shown) and can be held in place by means of a screw (not shown) passing through an aperture drilled in the web of the frame member 11 and engaging within a threaded aperture 13 within the body 1.

Figure 4:
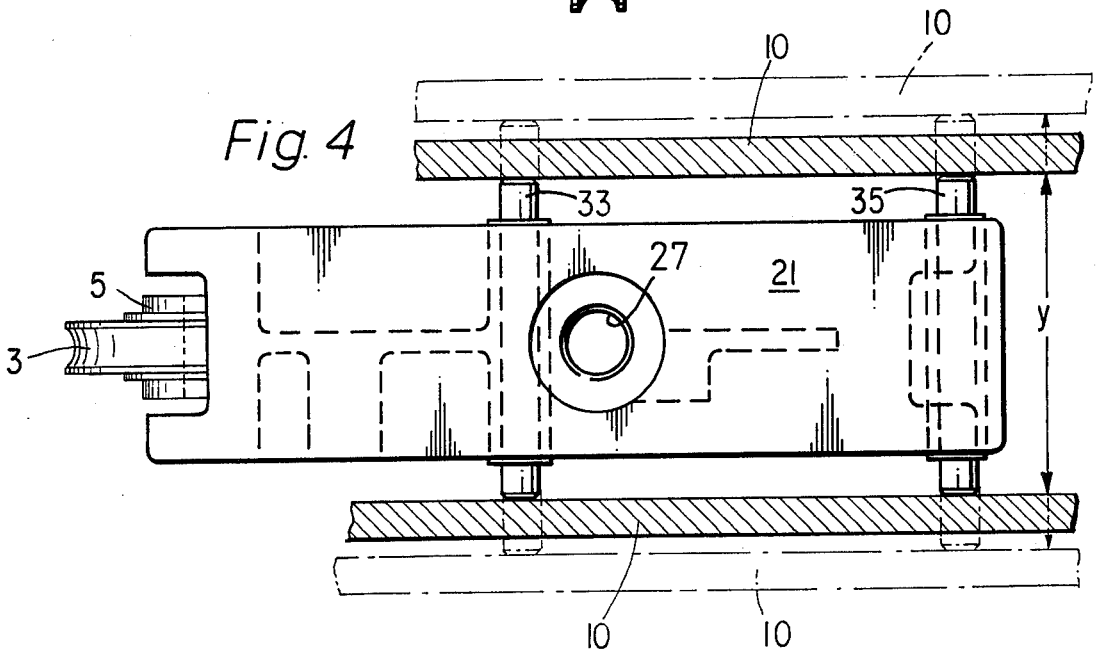
FIG. 4 is a plan view of the body shown in FIG. 3.
Figures 3, 5, 6, 7:
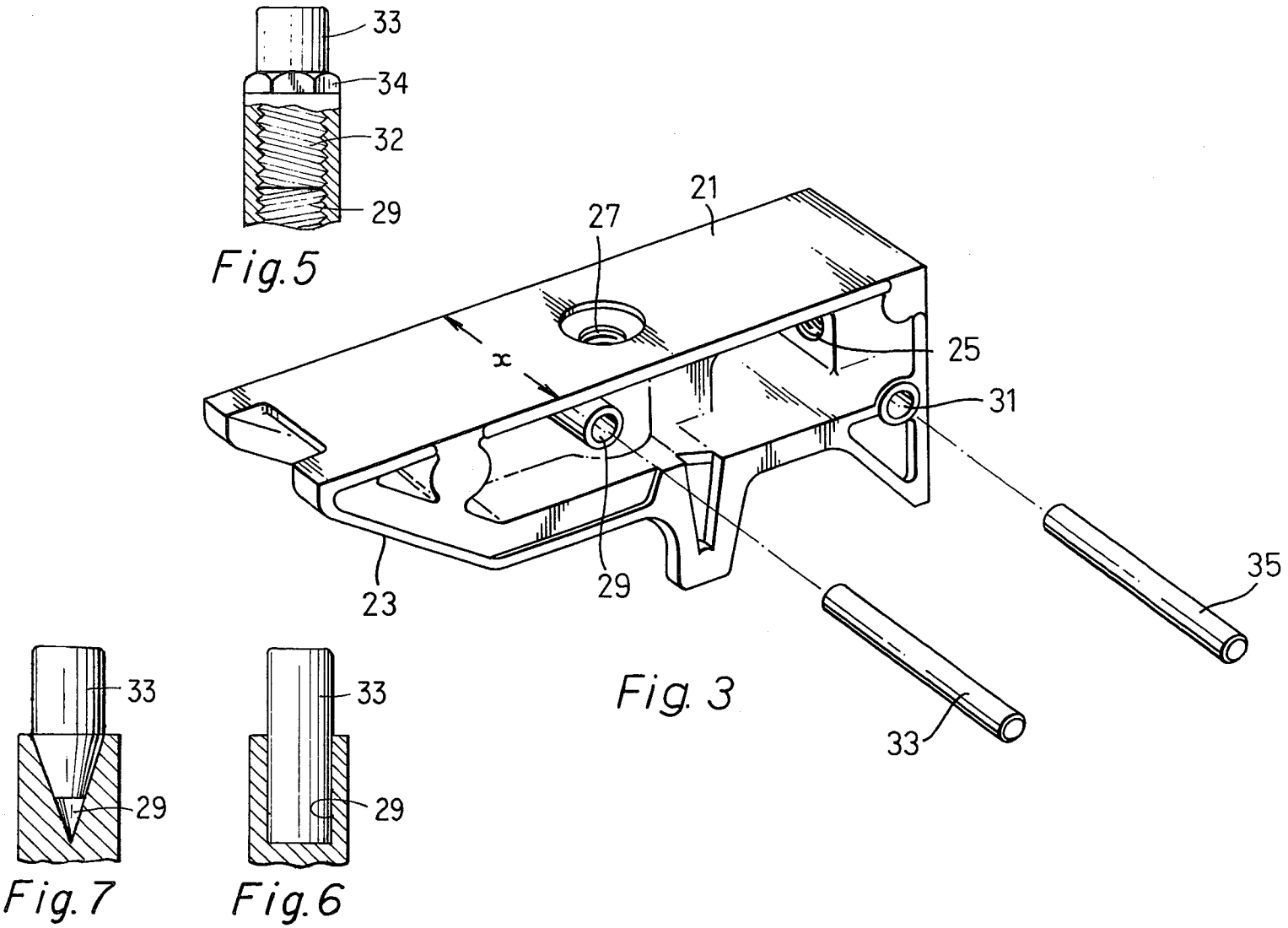
FIG. 3 is a perspective view of a roller body of the present invention.
FIG. 5 is a segmental view partially in section of another modification of the drillings and pins of this invention.
FIGS. 6 and 7 are views similar to FIG. 5 of still other possible modifications of the drillings and pins of this invention.

Reference will now be made to FIGS. 3 and 4 which show a roller body 21 constructed in accordance with the present invention. The body 21 is of similar design to the body 1 with a cam surface 23 against which a roller housing unit 5 including roller 3 can bear and with threaded mounting apertures 25 and 27. The width $x$ of the body 21 is made as small as possible so that the body will fit between walls 10 of the inverted channel portion of the bottom frame member of all known patio doors having a width $y$ illustrated in FIG. 4. In order to rigidly locate body 21 between walls 10 of the inverted channel section so that it will not rock from side to side or pivot when secured to the frame member by means of the aperture 25 or 27, transverse drillings 29 and 31 extend right through the body from one side face to the other. These drillings are of generally circular cross-section to receive locating pins 33 and 35. The locating pins 33 and 35 are both of the same length and are chosen from a set of different length pins. The pins in the set are of several predetermined lengths, which lengths are substantially equal to or correspond to the internal width $y$ between side walls 10 of the inverted channel section portions of the bottom frame members of all known patio doors. Hence, by choosing a pair of pins 33 and 35 of the desired length corresponding to the internal width $y$ of side walls 10 and fitting these into the drillings 29 and 31, the body 21 can be adapted for use with any known patio door. As best seen in FIG. 4, ends of pins 33, 35 shown in full lines engage wall surfaces of sectioned side walls 10, and ends of pins 33, 35 shown dotted engage wall surfaces of wider side walls 10 shown in phantom.

It will of course be appreciated that various modifications to the illustrated construction are possible some of which are illustrated in FIGS. 5–7. For example, the location of the drillings 29 and 31 can be altered and if desired extra drillings may be provided. The drillings 29 and 31 and/or the pins 33 and 35 respectively may be tapered (FIG. 7) or provided with screw threads 32 (FIG. 5) or without screw threads (FIG. 6), and in such modifications it is envisaged that four pins would be required for each body. The pins could be in the form of studs with hexagonal heads, not shown and obviously it might be desirable to provide suitable locking means, such as lock nuts 34 for all threaded pins.

It will be appreciated that the locating devices, i.e. the pins 33 or 35 or their equivalent, can be made from stainless or silver steel or from hard plastics material, nylon or the equivalent.

What is claimed is:

1. A roller support for a patio door having a bottom frame member which has a channel section having spaced apart wall surfaces, comprising a roller and a support body mounted between said wall surfaces of said channel section, said roller being supported on said support body, said support body having at least two side faces, each of said side faces having at least two spaced mounting means, and locating means mounted in said mounting means of said support body and having end portions engaging said spaced apart wall surfaces of said channel section for rigidly locating said support body with a close fit within said channel section.

2. The device of claim 1 wherein said mounting means comprise at least two transverse bores in each said side face, and said locating means comprise locating pins having a predetermined length such that when such locating pins are mounted in said bores, said body including said pins mounted in said mounting means has an external width and said spaced apart wall surfaces of said channel section has an internal width, which external and internal widths are substantially equal and correspond to one another.

3. The invention of claim 2 wherein a set of pins of various predetermined lengths is provided, said set including at least one group of locating pins which when mounted on said body provide a body having an external width including said pins corresponding or substantially equal to said internal width between said wall surfaces of said channel section.

4. The invention of claim 2 wherein said mounting means comprise at least two transverse bores extending through said body and said roller has a roller axis, said bores extending substantially parallel to said roller axis.

5. The invention of claim 4 wherein said bores and locating pins are substantially cylindrical, and said locating pins have a length corresponding or substantially equal to said internal width between said spaced apart wall surfaces of said channel section.

6. The invention of claim 2 wherein each bore and locating pin has at least a part of its length screw threaded for screw threaded engagement of said pins in said bores.

7. The invention of claim 6 wherein lock nuts are provided for locking said locating pins in position.

8. The invention of claim 2 wherein separate locating pins are provided on each said face of said body to form pairs of said bores and said locating pins, and one of said bores and said locating pins of each pair is substantially cylindrical and the other of said bores and said locating pins of each pair tapers inwardly so that said locating pins have a force fit relationship with said bores.

* * * * *